US007090535B2

(12) United States Patent
Wan et al.

(10) Patent No.: US 7,090,535 B2
(45) Date of Patent: Aug. 15, 2006

(54) ELECTRICAL CONNECTOR CAPABLE OF BEARING HIGH VOLTAGE

(75) Inventors: Qin Wan, Kunsan (CN); Hong Jun Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/993,664

(22) Filed: Nov. 19, 2004

(65) Prior Publication Data

US 2005/0112946 A1 May 26, 2005

(30) Foreign Application Priority Data

Nov. 21, 2003 (CN) ..... 200320119937

(51) Int. Cl.
*H01R 13/66* (2006.01)
*H01R 33/945* (2006.01)

(52) U.S. Cl. ..... 439/620

(58) Field of Classification Search ..... 439/620, 439/607, 676

See application file for complete search history.

(56) References Cited

U.S. PATENT DOCUMENTS 5,069,641 A 12/1991 Sakamoto et al.
6,786,772 B1 * 9/2004 Liu ..... 439/620

* cited by examiner

*Primary Examiner*—Javaid H. Nasri
(74) *Attorney, Agent, or Firm*—Wei Te Chung

(57) ABSTRACT

An electrical connector (100) mounted on a mother printed circuit board includes an insulative housing (1) defining a plug-receiving cavity (10), a conductive outer shield (2) enclosing the insulative housing, a terminal module (3) and a daughter circuit board (4) assembled into the plug-receiving cavity of the housing, and a connecting module (6) electrically connecting with the daughter circuit board. The connecting module includes a pair of first connecting contacts (61) for contacting with the daughter circuit board, a pair of second connecting contacts (62) for contacting with the mother printed circuit board and mode choke coils (65) for connecting with the first and the second connecting contacts. The electrical connector further includes a dielectric block (7) positioned between the second connecting contacts and the daughter circuit board.

8 Claims, 4 Drawing Sheets

ELECTRICAL CONNECTOR CAPABLE OF BEARING HIGH VOLTAGE

BACKGROUND OF THE INVENTION

1. Field of the Invention

This invention generally relates to an electrical connector and more particularly, to an electrical connector having excellent capability of bearing high voltage.

2. Description of the Prior Art

A conventional connector assembly generally provides an insulative housing, a plurality of conductive contacts, a daughter circuit board and mounting terminals for mounting the connector assembly on a mother printed circuit board, as is disclosed in U.S. Pat. No. 5,069,641. In this patent, the mounting terminals close each other, thereby easily arising magnetic interference and decreasing the reliability of signal transmission. In order to overcome the above shortcomings, one conventional connector assembly adopts a connecting module behind the daughter circuit board. The connecting module includes a plurality of first and second connecting contacts positioned an upper and lower portions thereof, respectively. The connecting module further includes a plurality of mode choke coils for electrically connecting the first and second connecting contacts and a receiving room for receiving the mode choke coils, thereby decreasing the interference each other. However, the second connecting contacts close to the daughter circuit board, therefore interference exists still. As a result, dielectric glue is used between the second connecting contacts and the daughter circuit board, but the glue has relative great fluidity and need a long time to be solidified, thereby complicating the operation and increasing the cost of the electrical connector.

The present invention is directed to solving the above problems by a dielectric block for spacing the connecting contacts and the daughter circuit board.

BRIEF SUMMARY OF THE INVENTION

It is an object of the present invention to provide an electrical connector which can reliably transmit signal and be easily manufactured.

In order to attain the object above, an electrical connector according to the present invention comprises an insulative housing defining a plug-receiving cavity, a conductive outer shield enclosing the insulative housing, a terminal module having a plurality of conductive terminals, a daughter circuit board electrically connecting the terminal module and a connecting module abutting against a rear surface of the insulative housing for electrically connected with the daughter circuit board. The daughter circuit board and the terminal module are unitarily mounted in the plug-receiving cavity of the insulative housing. The conductive terminals of the terminal module have a plurality of contact sections extending into the plug-receiving cavity of the insulative housing. The connecting modules includes a plurality of first connecting contacts for electrically contacting with the daughter circuit board, a plurality of second connecting contacts for electrically contacting with a mother printed circuit board and a plurality of mode choke coils for connecting with the first and the second contacts. The electrical connector further includes a dielectric block positioned the second connecting contacts of the connecting module and the daughter circuit board. In the present invention, the dielectric block spaces the second connecting contacts from the daughter circuit board, thereby decreasing the magnetic interference between the connecting contacts and the daughter circuit board.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
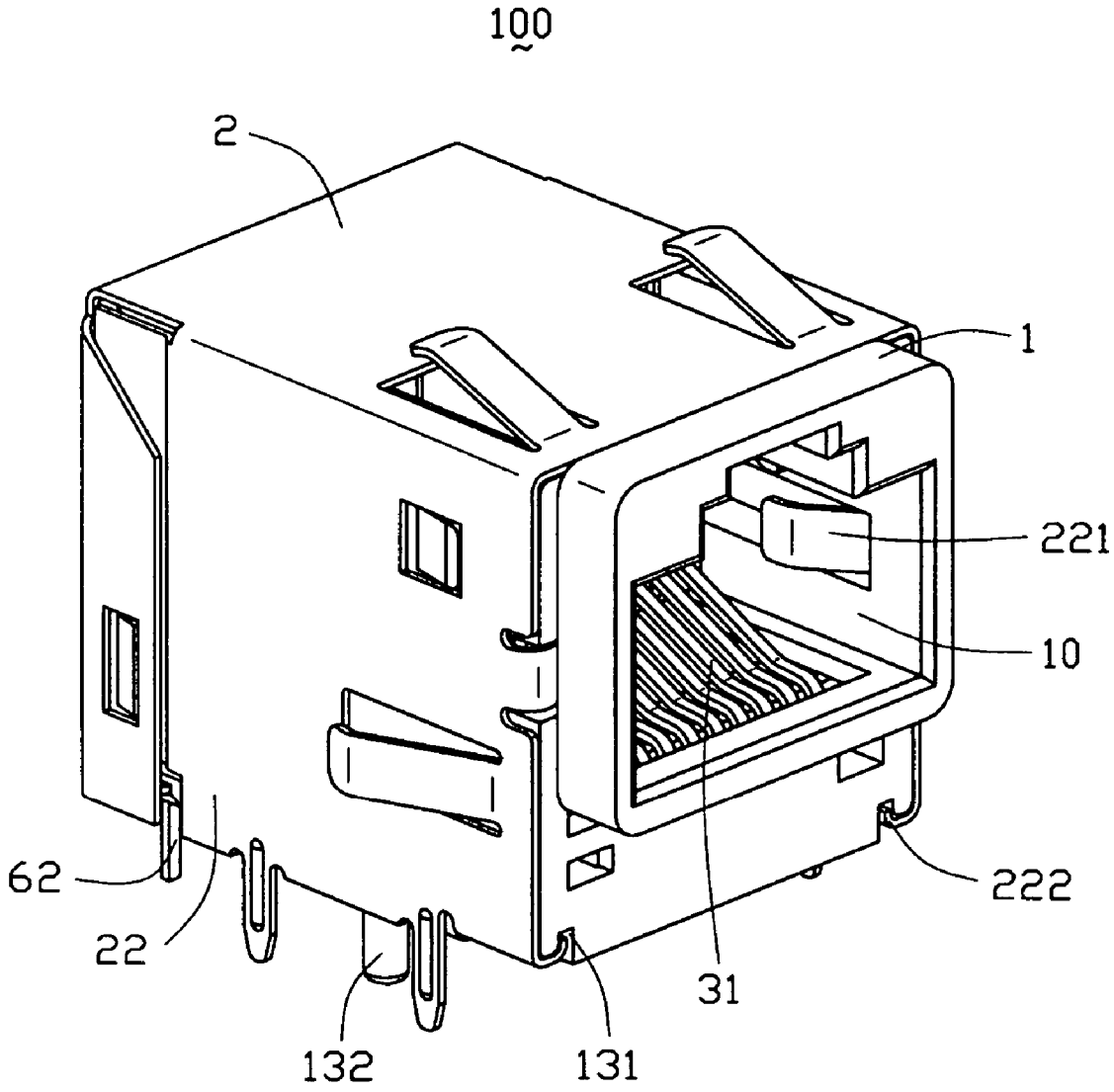
FIG. 1 is a perspective view of an electrical connector according to the present invention.
Figure 2:
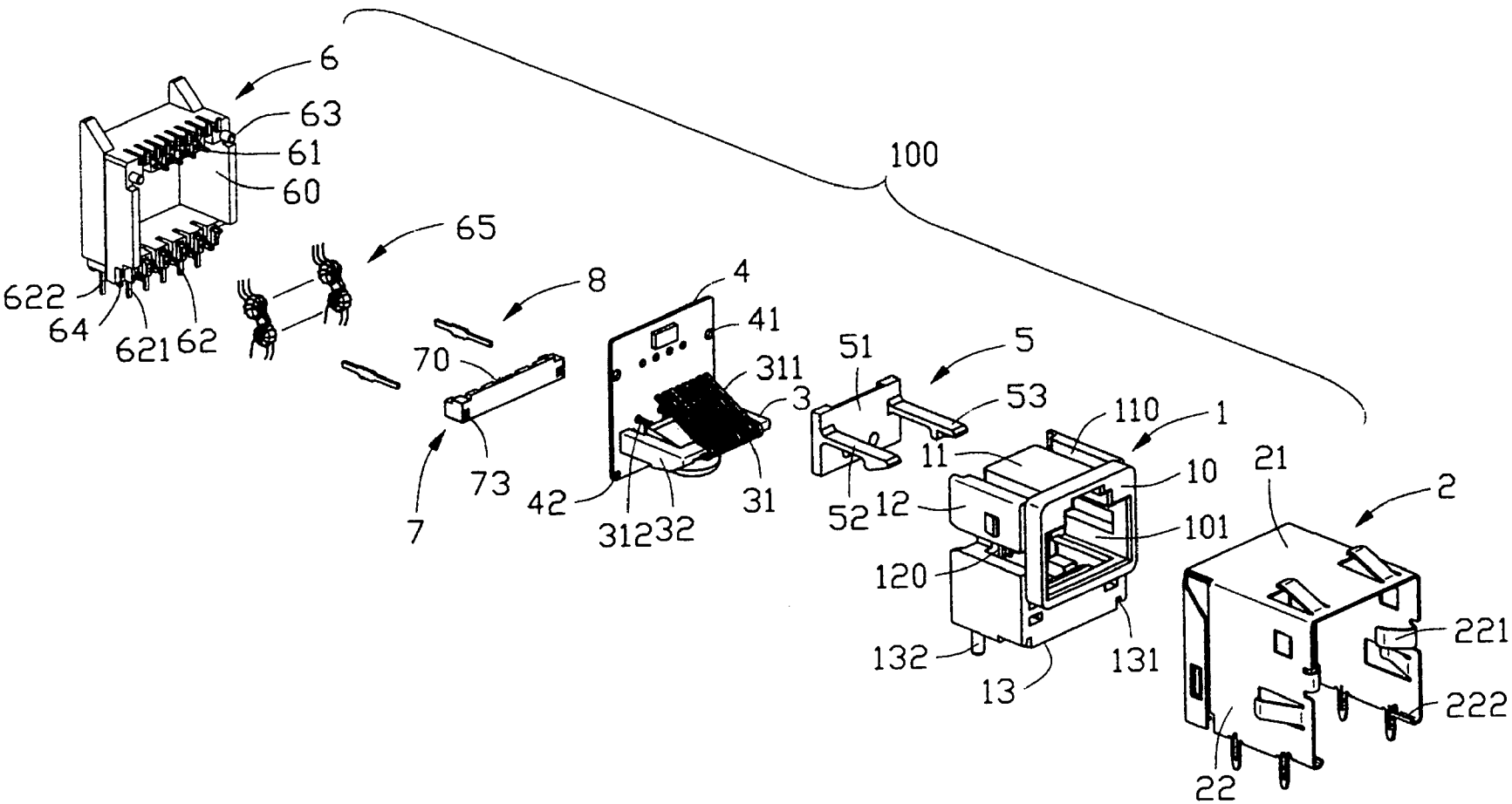
FIG. 2 is an exploded view of FIG. 1.

Referring to FIG. 2, an electrical connector 100 in accordance with the present invention is mounted on a mother printed circuit board (PCB, not shown) and includes an insulative housing 1, a conductive outer shield 2 enclosing the housing 1, a terminal module 3, a daughter circuit board 4, an anti-mismating device 5, a connecting module 6 and a dielectric block 7. The electrical connector 100 further has a pair of dowel pins 8 for securing the connecting module 6 and the dielectric block 7 on the daughter circuit board 4.

Figure 3:
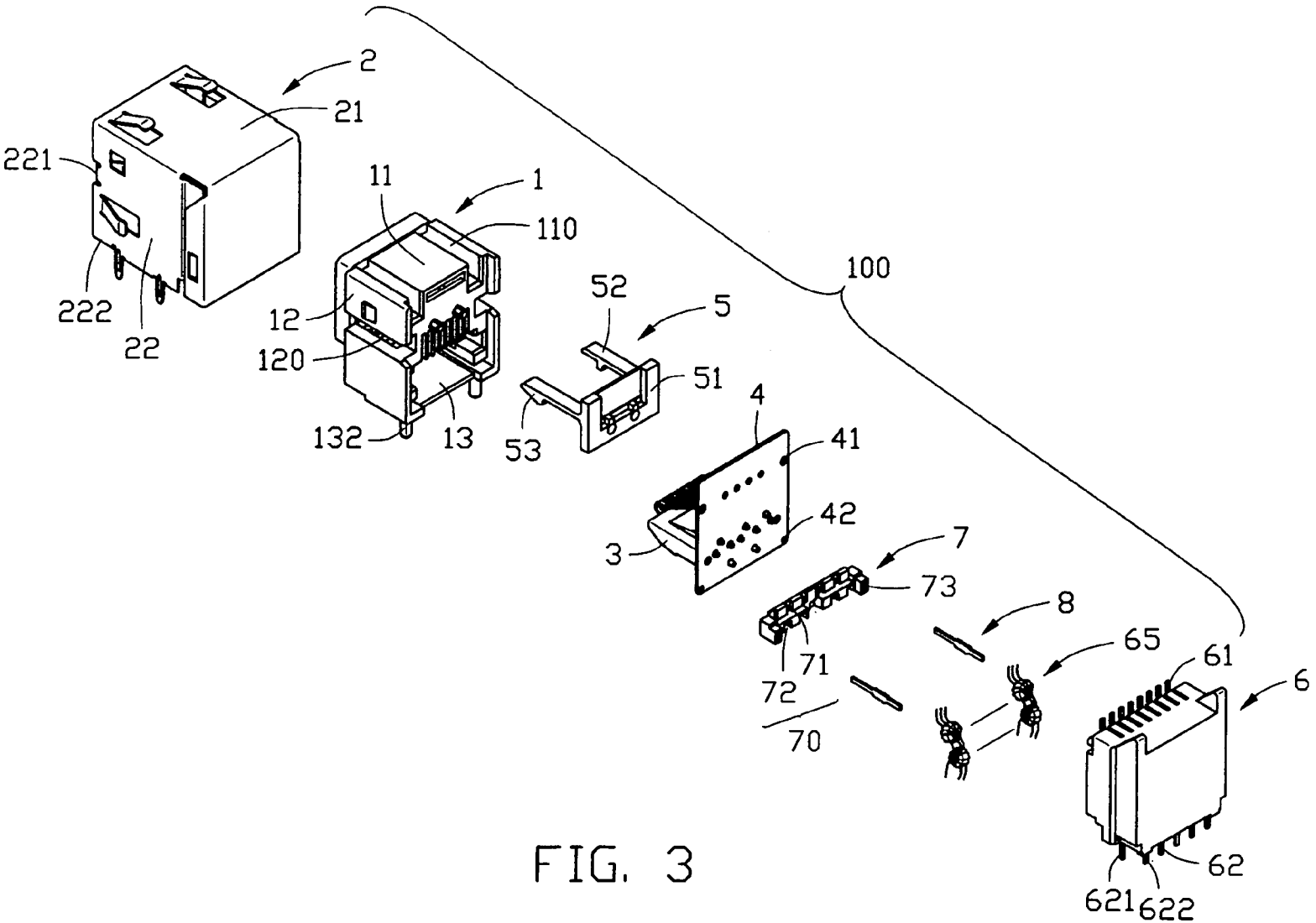
FIG. 3 is another exploded view of FIG. 1.
Figure 4:
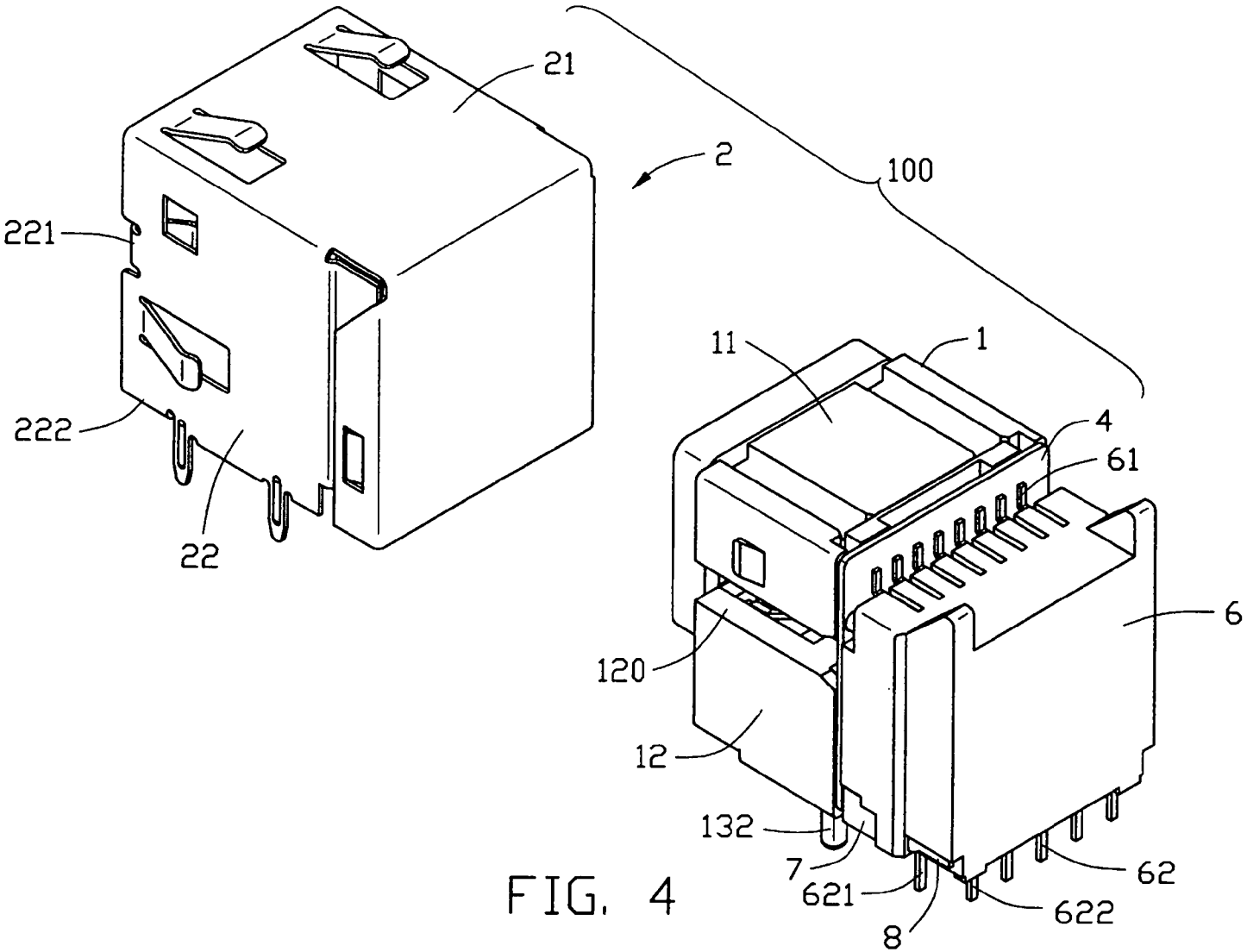
FIG. 4 is a partially assembled view of FIG. 3.

Referring to FIG. 2 in conjunction with FIG. 3, the housing 1 comprises a pair of side walls 12, a top wall 11, a bottom wall 13 and a front mating face 10. The housing 1 has a plug-receiving cavity 101 extending rearward from a front mating face 10 of the housing 1 for receiving a complementary mating plug connector (not shown). The top wall 11 defines a pair of slots 110 in opposite sides thereof. Each side wall 12 has an opening 120 through a middle portion thereof. The bottom wall 13 has a pair of recesses 131 in opposite sides thereof, as will be described in more detail hereinafter. A pair of posts 132 project downwardly from the bottom wall 13 for engaging with counterpart positioning portions of the mother PCB.

The conductive outer shield 2 securely holds the housing 1 therein and comprises a top plate 21 and a pair of side plates 22. A pair of spring barbs 221 for entering the openings 120 of the housing 1 are backwardly and inwardly bent from the front edges of corresponding side plates 22, respectively. Each side plate 22 has a retaining portion 222 extending inwardly and upwardly from a bottom end thereof. The retaining portions 222 are substantially U-shaped for engaging with corresponding recesses 131 of the housing 1.

The terminal module 3 includes a plurality of conductive terminals 31 and a base portion 32. Each conductive terminal 31 includes a contact section 311, a soldering section 312 soldered to the daughter circuit board 4 and a retaining section (not shown) embedded in the base portion 32.

The daughter circuit board 4 comprises an array of electrical traces (not shown), and a pair of first and second mounting holes 41, 42 respectively located in the upper and lower portions thereof. The daughter circuit board 4 also can position additional signal conditioning components (not shown) thereon.

The anti-mismating device 5 comprises a body portion 51, a pair of cantilevered beams 52 forwardly extending from the body portion 51 for extending into the slots 110 of the housing 1, and a pair of engaging sections 53 respectively located in front of the cantilevered beams 52.

The connecting module 6 comprises a receiving room 60, a plurality of mode choke coils 65 received in the receiving room 60, and a plurality of first and second connecting contacts 61, 62 respectively located on upper and lower portions thereof. The first connecting contacts 61 are electrically connected with the second connecting contacts 62 by the mode choke coils 65. It should be understood that the connecting manner among the connecting contacts 61, 62 and the mode choke coils 65 is well known in the prior art, therefore, the connecting manner is not shown in the present invention and a detailed description thereof is omitted herefrom. The connecting module 6 has a pair of retaining sections 63 for interference fitting with the mounting holes 41 of the daughter circuit board 4 on opposite sides of the upper portion thereof. The connecting module 6 defines a pair of grooves 64 in opposite sides of lower portion thereof for receiving the dowel pins 8. The second connecting contacts 62 include a front array contacts 621 and a rear array contacts 622. The front and rear array contacts 621, 622 are substantially L-shaped and are parallel to each other. The front array contacts 621 are spaced and distance from the rear array contacts 622. Ends of the front array contacts 621 are positioned over ends of the rear array contacts 622.

The dielectric block 7 includes a plurality of passageways 70 for receiving the ends of the second connecting contacts 62. It should be understood that the passageways 70 also can be formed of holes. The passageways 70 include an array upper passageways 71 for receiving corresponding front array contacts 621 and an array lower passageways 72 for receiving corresponding rear array contacts 622. The dielectric block 7 further includes a pair of channels 73 for receiving the dowel pins 8 positioned on opposite sides thereof.

Referring to FIGS. 1–4, in assembly, firstly, the anti-mating device 5 is fixed on the top wall 11 of the housing 1. The cantilevered beams 52 of the anti-mating device 5 extend into the slots 110 of the top wall 11 of the housing 1. The engaging sections 53 of the cantilevered beams 52 extend into the plug-receiving cavity 101 of the housing 1. The body section 51 of the anti-mating device 5 abuts a rear surface of the housing 1. Secondly, the terminal module 3 is mounted to the daughter circuit board 4. The soldering sections 312 of the conductive terminals 31 are soldered to the corresponding electrical traces of the daughter circuit board 4. The terminal module 3 is received in the plug-receiving cavity 101 and the daughter circuit board 4 is mounted on the housing 1 from a rear surface of the housing 1. Thirdly, the connecting module 6 and the dielectric block 7 are both assembled to a rear surface of the daughter circuit board 4. The front array contacts 621 and the rear array contacts 622 of the connecting module 6 are inserted into the upper and lower passageways 71, 72, respectively. As a result, the front and rear array contacts 621, 622 are spaced by the dielectric block 7. Therefore, the front and rear array contacts 621, 622 do not interfere each other in signal transmission and achieve steady transmission signals. The first connecting contacts 61 of the connecting module 6 are soldered to the appropriate electrical traces of the daughter circuit board 4, with the retaining sections 63 of the connecting module 6 interference fitting in the first mounting holes 41 of the daughter circuit board 4. The dowel pins 8 are inserted into the grooves 64 of the connecting module 6 and the channels 73 of the dielectric block 7 and extend forwardly to mate with the second mounting holes 42 of the daughter circuit board 4, thereby electrically connecting with the daughter circuit board 4. The dowel pins 8 rearward extend beyond the grooves 64 and electrically connect with the conductive outer shield 2. The conductive outer shield 2 forms a plurality of downwardly extending mounting legs (not labeled) for soldering to ground traces of the mother printed circuit board. Therefore, a continuous ground connection is established between the daughter circuit board 4 and the mother printed circuit board. At the same time, the second connecting contacts 62 are spaced from the daughter circuit board 4 by the dielectric block 7, thereby not producing magnetic interference between the second connecting contacts 62 and the daughter circuit board. Finally, the conductive outer shield 2 encloses the housing 1. The retaining portions 222 of the conductive outer shield 2 interfere with the recesses 131 of the housing 1. Therefore, the conductive outer shield 2 is securely mounted to the housing 1.

Comparing with prior arts, the electrical connector 100 according to the present invention adopts a dielectric block 7 between the second connecting contacts 62 and the daughter circuit board 4, as a result, the dielectric block 7 spaces the front array connecting contacts 621 from the rear array connecting contacts 622, thereby preventing the magnetic interference among the front and rear array connecting contacts 621, 622 and the daughter circuit board 4. At the same time, the dielectric block 7 is not poisonous, thereby not influencing the healthy of operator. In addition, the assembly of the electrical connector 100 is relative simple and handle easily.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted for mounting on a printed circuit board comprising:

an insulative housing defining a cavity;

terminal module comprising a plurality of conductive terminals, each conductive terminal comprising a contacting portion extending into the cavity of the insulative housing;

a daughter circuit board abutting a rear surface of the housing and electrically connecting with the terminals of the terminal module;

a connecting module comprising a plurality of first connecting contacts for connecting with the daughter circuit board, a plurality of second connecting contacts for connecting with a printed circuit board, and a plurality of mode choke coils for connecting with the first and the second connecting contacts; and a dielectric block positioned between the second connecting contacts of the connecting module and the daughter circuit board; wherein the connecting module has a pair of retaining sections projecting from opposite sides of an upper portion thereof, and wherein the daughter circuit board includes a pair of first mounting boles for receiving the retaining sections.

2. The electrical connector according to claim 1, wherein said dielectric block includes a plurality of spaced passageways, and wherein the passageways includes an array of first passageways and an array of second passageways.

3. The electrical connector according to claim 2, wherein the second connecting contacts of the connecting module includes an array of first connecting contacts inserted into the first passageways and an array of second connecting contacts inserted into the second passageways.

4. The electrical connector according to claim 1, further comprising a pair of dowel pins, and wherein said connecting module has a pair of gooves, and wherein said daughter circuit board has a pair of second mounting boles, two opposite ends of said dowel pin respectively secured into the groove and the second mounting holes to interconnect the daughter board, the dielectric block and the connecting module.

5. The electrical connector according to claim 4, wherein said dielectric block includes a pair of channels positioned at opposites sides thereof for fixing the dowel pins.

6. The electrical connector according to claim 1, further including a conductive outer shell for enclosing the insulative housing, the outer shell including a pair of side plates, a swing tab rearward extending from a front edge of each side plate, and a substantially U-shaped retaining portion inwardly and upwardly extending from a bottom end of each side plate.

7. The electrical connector according to claim 6, wherein the insulative housing defines a pair of openings for receiving the spring tabs of the conductive outer shell.

8. The electrical connector according to claim 6, wherein the insulative housing includes a bottom wall having a recess for interference fitting with the retaining portion of the conductive outer shield.

* * * * *